US011925257B1

(12) United States Patent
Downey et al.

(10) Patent No.: US 11,925,257 B1
(45) Date of Patent: Mar. 12, 2024

(54) FOLDABLE WORKING SURFACE BOARD

(71) Applicants: Nancy Downey, Woodland Hills, CA (US); Bernadett Boyko, Woodland Hills, CA (US)

(72) Inventors: Nancy Downey, Woodland Hills, CA (US); Bernadett Boyko, Woodland Hills, CA (US)

( * ) Notice: Subject to any disclaimer, the term of this patent is extended or adjusted under 35 U.S.C. 154(b) by 0 days.

(21) Appl. No.: 17/968,769

(22) Filed: Oct. 18, 2022

Related U.S. Application Data

(60) Provisional application No. 63/257,173, filed on Oct. 19, 2021.

(51) Int. Cl.
*A47B 3/00* (2006.01)

(52) U.S. Cl.
CPC ..... *A47B 3/002* (2013.01)

(58) Field of Classification Search
CPC ..... A47B 3/002; A47B 3/083; A47B 1/03; A47B 1/10; A47B 2001/035; A47B 13/081
See application file for complete search history.

(56) References Cited

U.S. PATENT DOCUMENTS

| | | | | |
|---|---|---|---|---|
| 4,221,173 | A * | 9/1980 | Sanford, Jr. | A47B 1/00 108/14 |
| 4,282,817 | A * | 8/1981 | Gutterman | A47B 1/00 108/11 |
| 9,915,057 | B2 * | 3/2018 | Williams | E03C 1/186 |
| 2012/0285351 | A1 * | 11/2012 | Cohen | A47B 3/10 108/166 |
| 2018/0035800 | A1 * | 2/2018 | Okeke | H04M 1/04 |
| 2018/0213926 | A1 * | 8/2018 | Brensinger | F16B 12/44 |
| 2019/0098993 | A1 * | 4/2019 | Brensinger | E04H 15/42 |
| 2020/0305593 | A1 * | 10/2020 | Brensinger | A47B 3/083 |
| 2021/0153643 | A1 * | 5/2021 | Haddy | A47B 23/002 |

FOREIGN PATENT DOCUMENTS

| | | | | |
|---|---|---|---|---|
| CN | 205513176 | U | 8/2016 | |
| DE | 19713363 | A1 | 10/1998 | |
| EP | 1733645 | A1 * | 12/2006 | A47B 1/04 |
| FR | 474620 | A | 3/1915 | |
| GB | 847405 | A | 9/1960 | |

OTHER PUBLICATIONS

"Aprata Shirt Folding Board Adult Size Adjustable Clothes Easy Laundry Clothing Folder Organize Board Folding Boards Blue," amazon.com. https://www.amazon.com/APRATA-Folding-Adjustable-Organize-Flipfold/dp/B0895JSR9Y/ref=sr_1_38?dchild=1&keywords=folding+board+hinges&qid=1621267404&sr=8-38 [Date accessed: May 17, 2022].

* cited by examiner

*Primary Examiner* — Daniel J Rohrhoff
(74) *Attorney, Agent, or Firm* — Bold IP, PLLC

(57) ABSTRACT

A folding surface board is provided having at least six tiles. The folding surface board can be folded to provide working surfaces where all of the working surfaces of the folding surface board are fully exposed to being fully folded such that all of the tiles are stacked on top of each other while still connected to each other along their folded edges. The folding surface board can be divided in half, or such that only two working surfaces are exposed and a remaining number of tiles folded under the other exposed working surfaces. Sliding mechanisms are attached on an underside of the folding surface board such that the folding surface board can be locked in a fully expanded or partial configuration using the sliding mechanisms to lock and keep the desired number of tiles exposed and locked in place.

19 Claims, 14 Drawing Sheets

FOLDABLE WORKING SURFACE BOARD

CROSS-REFERENCE TO RELATED APPLICATIONS

This application is a non-provisional application which claims priority to U.S. Provisional Patent Application No. 63/257,173 filed on Oct. 19, 2021, which is incorporated by reference in its entirety.

FIELD OF THE DISCLOSURE

The present invention relates to a new foldable and expandable working surface board that is configured to adjust to a myriad of folds and configurations to provide the user with a desired number of working surfaces from the foldable and expandable working surface board.

BACKGROUND

People use various types of working surfaces to complete tasks such as writing, reading, drawing, eating, or a multitude of other activities that people engage in. Tables and trays and tablets are limited in that usually the working surface has a fixed surface area. In other words, the working surface of the table, trays such as serving trays, breakfast trays, or any other kind of trays, desktop, or other type of working surface is not configured to be foldable and adjustable over a variety of configurations to expose more or less working surface. Further, tables and other types of working surfaces are not usually easily portable or stowable in a bag or small space.

Accordingly, there is a need for an alternative to the existing fixed tables and other working surfaces that provides flexibility and modularity to the user to determine how much of a working surface the user needs and to be able to expand or retract the working surface to the size needed.

SUMMARY

A folding surface board, according to one or more non-limiting embodiments comprising, a body having at least six tiles connected to each other to form an overall rectangular shape comprised of the at least six tiles. Each tile of the at least six tiles is divided by one or more folding edges, wherein the at least six tiles when fully expanded are divided in a three by two (3×2) configuration with three tiles on a top row connected to three tiles on a bottom row of the folding surface board when fully expanded. The folding surface board further includes a set of sliding mechanisms attached to an underside of the body, whereby the folding surface board is configured to be manipulated from a fully expanded to a partially expanded to a fully folded configuration.

In one aspect, the set of sliding mechanisms may comprise drawer slides, whereby the drawer slides comprise a stationary member and a traveling member, and whereby a drawer snap is connected to the traveling member of each drawer slide. Further, the underside of the body of the folding surface board comprises a set of drawer slide gaps dedicated to storing the set of drawer slides. Further, the length of the set of drawer slide gaps is at least as long as a length of a drawer slide when the traveling member of the drawer slide is fully extended, whereby the set of drawer slide gaps is configured to store the drawer slide in its fully extended and fully retracted state. Further, the number of the set of drawer slide gaps is equivalent to a number of the set of drawer slides. Additionally, the set of drawer slide gaps comprises an opening at an end of each drawer slide gap configured to receive a tab on the drawer snap, wherein the tab is configured to adjustably and temporarily lock the tab of the drawer snap attached to each drawer slide in place. Further, in a non-limiting embodiment, the tile has at least one drawer slide gap built into or located on an underside of each tile. Further, all six tiles can be folded in a fully folded configuration whereby the all six tiles are stacked on top of each other with one upward facing exposed working surface. Further, the at least six tiles are configured to fold in half wherein there are three exposed working surfaces on three upward facing tiles of the at least six tiles, and a remaining set of tiles are folded beneath the three upward facing tiles.

In another aspect, the at least six tiles are configured to be folded such that there are two exposed working surfaces on two upward facing tiles of the at least six tiles, and a remaining set of tiles are folded beneath the two upward facing tiles. Further, each tile has a rectangular shape or a square shape, and further wherein each tile of the at least six tiles share at least two foldable edges with another tile. In a non-limiting embodiment, each tile comprises a recessed underside with one or more ribs protruding down from the recessed underside.

In a non-limiting embodiment, the present description includes a method of using a folding surface board. The method further including determining how many working surfaces of one or more tiles of the folding surface to expose and how many remaining tiles of the folding surface board to fold, wherein the folding surface board comprises at least six tiles connected to each other by at least one folding edge. The method may further include, responsive to determining how many exposed working surfaces of the one or more tiles of the folding surface to expose and how many remaining tiles of the folding surface board to fold, folding or unfolding a required number of tiles to display a desired number of working surfaces of the one or more tiles of the folding surface. The method may further include folding the folding surface board in half such that three tiles of the folding surface board are connected to each other with exposed, upward facing tiles and three tiles are folded under the folding surface board.

The method may further include folding the folding surface board such that all six tiles are stacked on top of each other while connected to each other.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

The present description is drawn to an adjustable and expandable folding surface board that can be configured to be fully expanded, partially expanded, and fully folded in one or more adjustable configurations to suit the needs of the user. The adjustable and expandable folding surface board as described herein has multiple benefits and advantages over existing options for writing, reading, or working surfaces. In one or more non-limiting embodiments, the foldable and adjustable folding surface board may be adjustable in length and width and may also be stackable to create a working surface with a desired height. The folding surface board, in one or more non-limiting embodiments, is generally flat. The folding surface board, in one or more non-limiting embodiments, may be comprised of multiple tiles that have a top surface and a bottom surface. There may be multiple sliding locks and multiple hinges with pivot points to allow the multiple tiles to be folded along fold seam lines and adjusted to expose a particular number of tiles. Additional details are provided with respect to the Figures.

Figure 9:
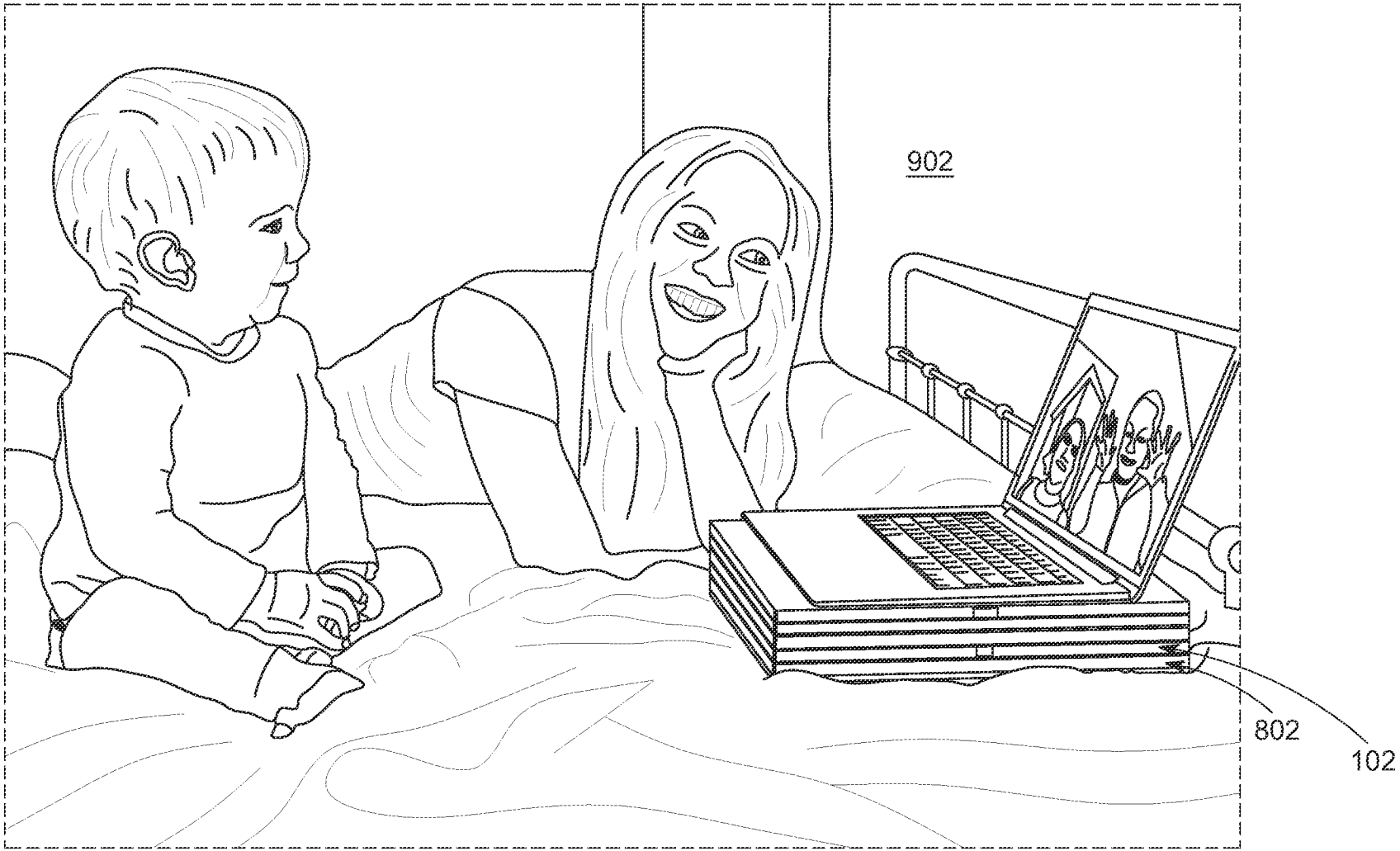
FIG. 9 depicts an exemplary use of the folding surface board in a fully folded position with all the portions of the folding surface board stacked one over the other.
Figure 10:
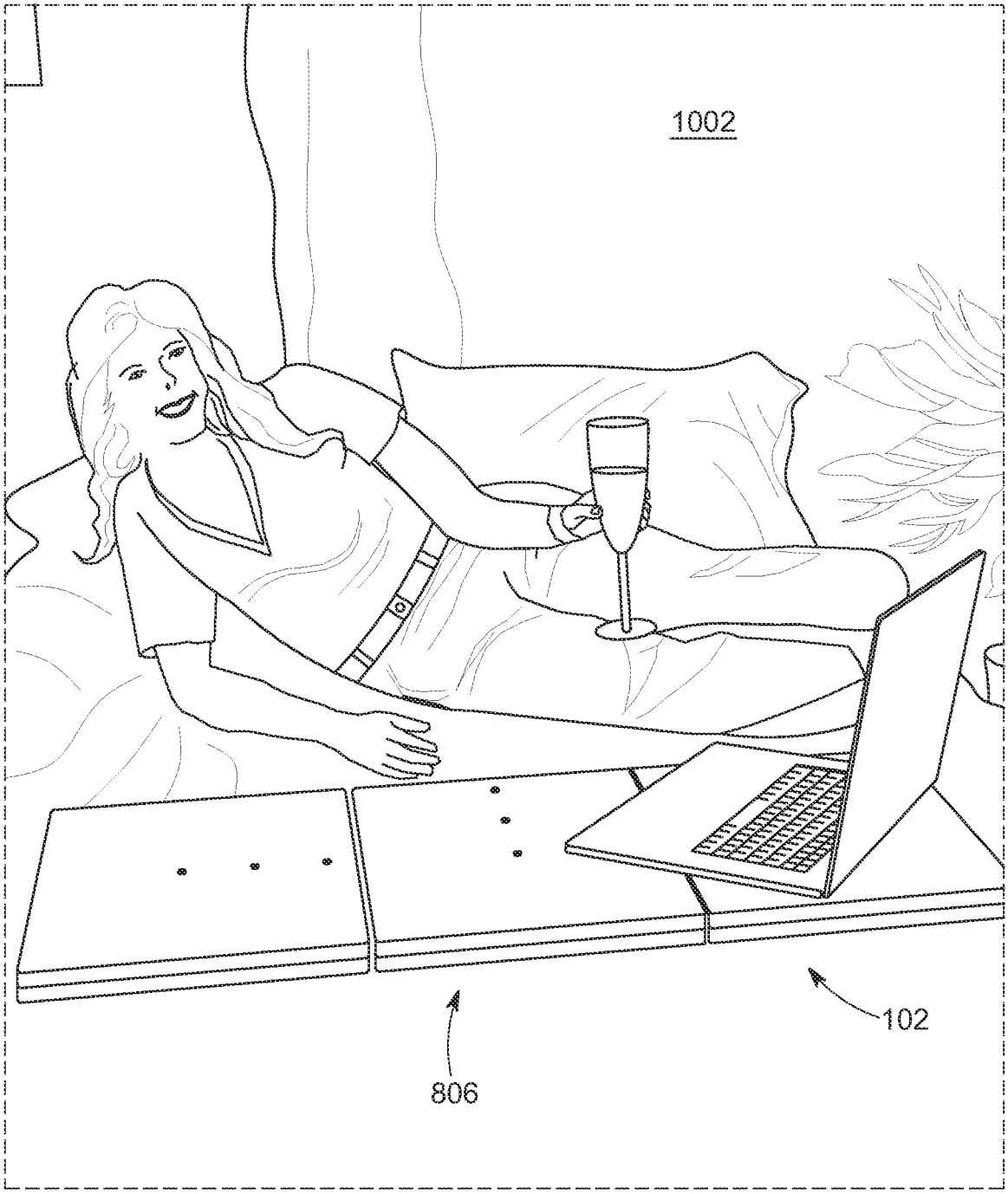
FIG. 10 depicts another exemplary use for the folding surface board in the half folded configuration.
Figure 11:
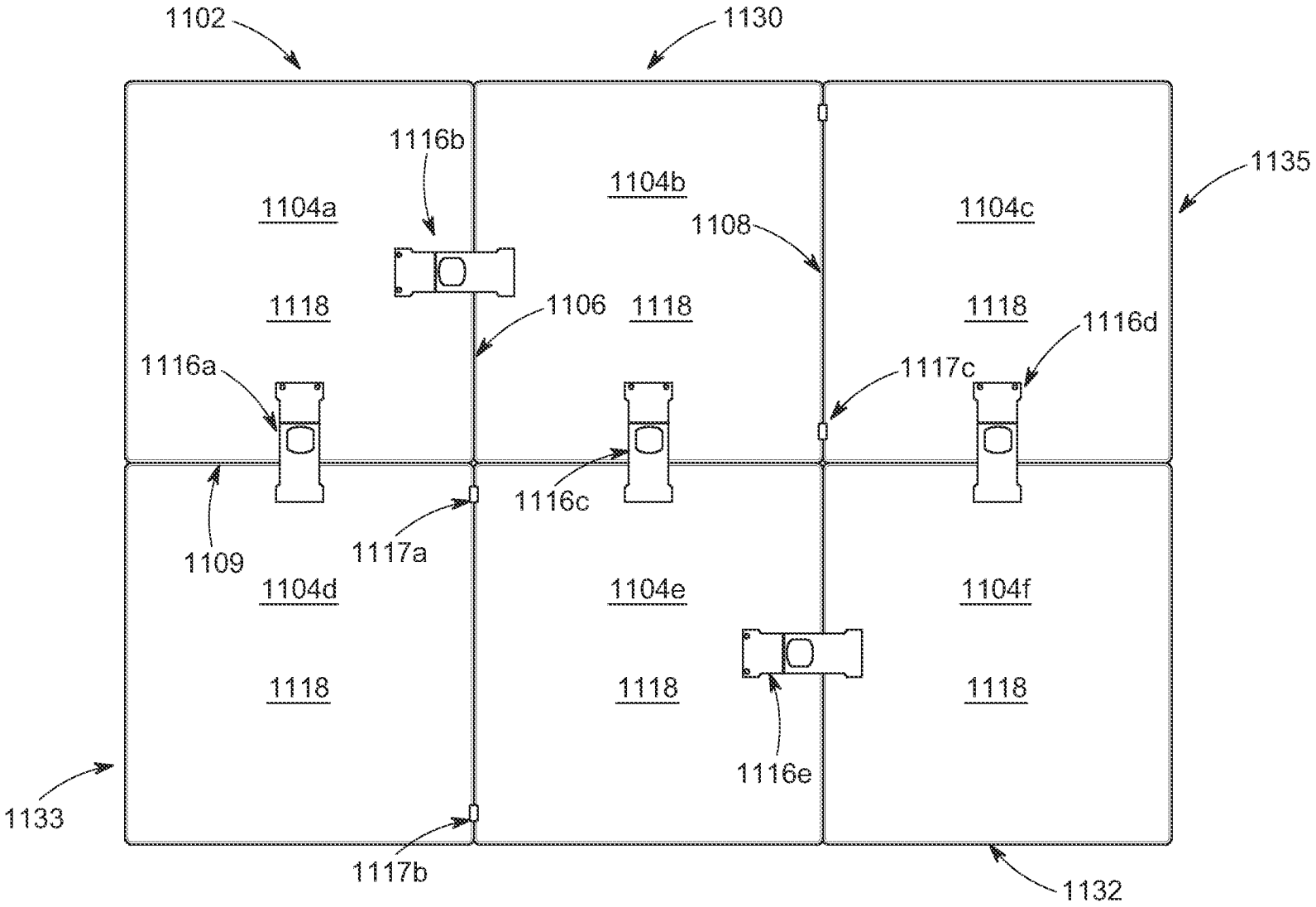
FIG. 11 depicts a pictorial illustration of an underside of another example of a folding surface board having multiple sliding locks.
Figure 12:
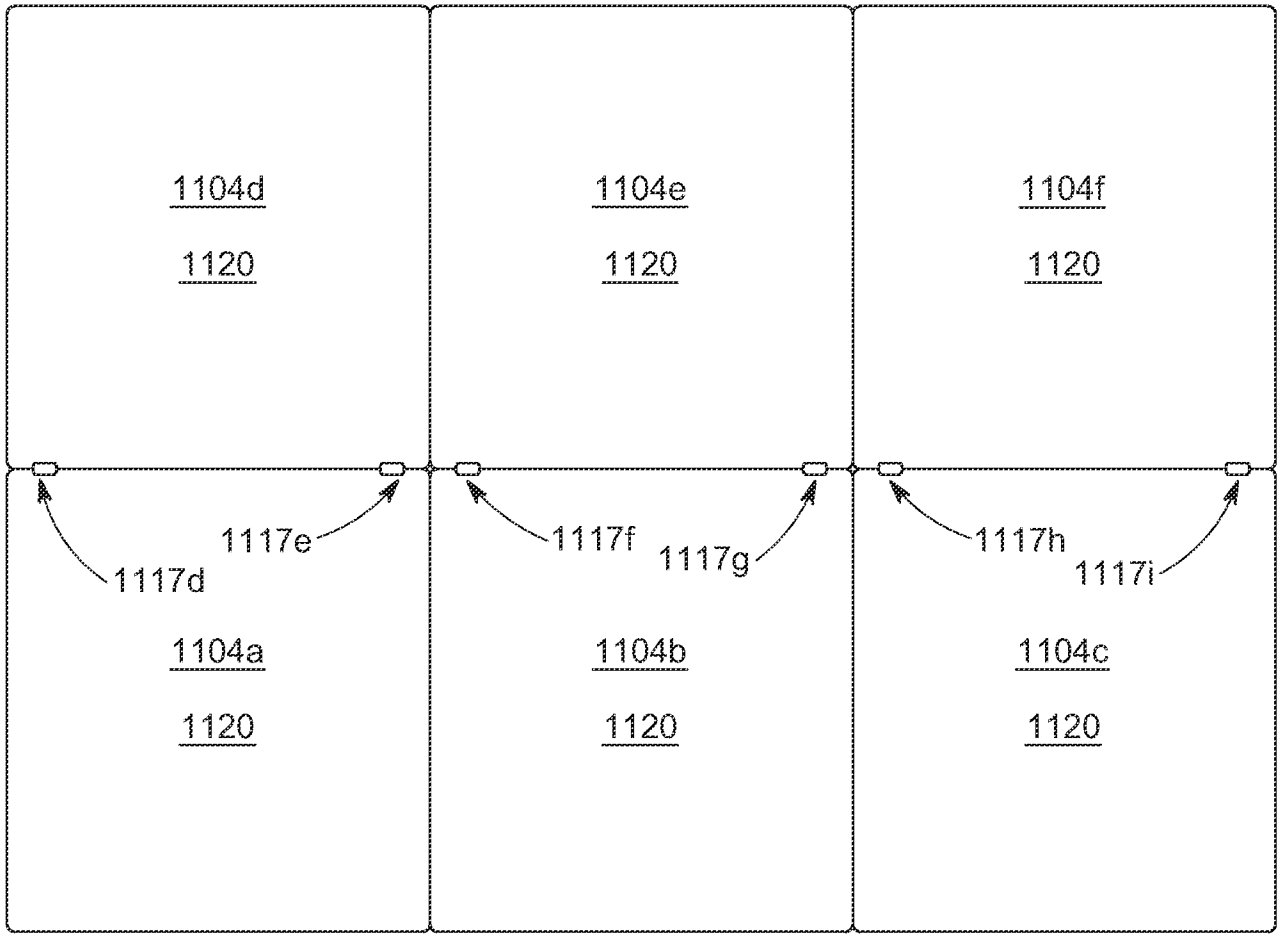
FIG. 12 depicts a pictorial illustration of a top side of a folding surface board shown in FIG. 11.
Figure 13:
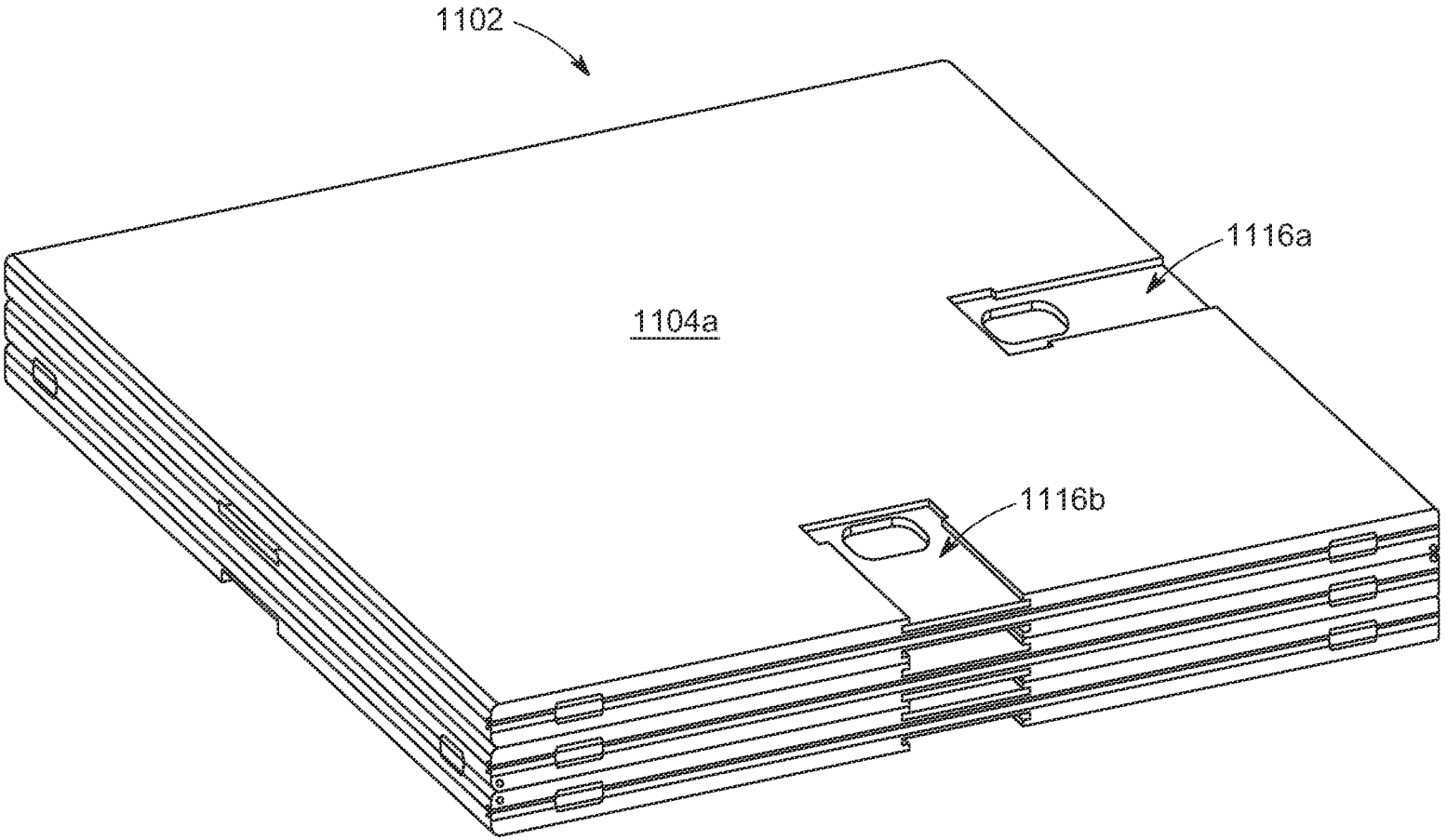
FIG. 13 depicts a fully folded folding surface board shown in FIG. 11.

FIGS. 1-13 show various configurations and views of an exemplary folding surface board 102 as shown in FIGS. 1-10 and 1102 as shown in FIGS. 11-13 in accordance with a non-limiting embodiment. The folding surface boards 102 and 1102 as shown in FIGS. 1-13 can be used for multiple configurations. Notably, the folding surface boards 102 and 1102 as shown in FIGS. 1-13 are portable, lightweight, yet sturdy and durable. The top surface of the folding surface boards 102 and 1102 includes six foldable connected square or rectangular pieces that can act as individual working surfaces when any of the surfaces of the square or rectangular pieces are exposed (e.g., exposed working surfaces). Notably, the folding surface boards 102 and 1102 as shown in FIGS. 1-13 may act as a substitute for a table surface and can support and accommodate a variety of items, including food or drink items as well as other physical devices or objects. For example, the folding surface boards 102 and 1102 as shown in FIGS. 1-13 can be used as working surfaces for writing and/or homework, studies, or any academic work. The folding surface boards 102 and 1102 as shown in FIGS. 1-13 may also be used for entertainment purposes to unfold a portable surface that is adjustable and configurable to accommodate various sizes to support board games, cards, computers, laptops, or any other device or item. Further, the folding surface boards 102 and 1102 may be folded in half and easily used to cover a user's lap in either an automobile or plane and act as a working surface that is sturdy and expandable to a desired size. Further, the folding surface boards 102 and 1102 may be useful for any type of display or presentation needs, and is useful in that the folding surface boards 102 and 1102 are easily stored and folded or unfolded as needed to a desired size and configuration.

Figure 1:
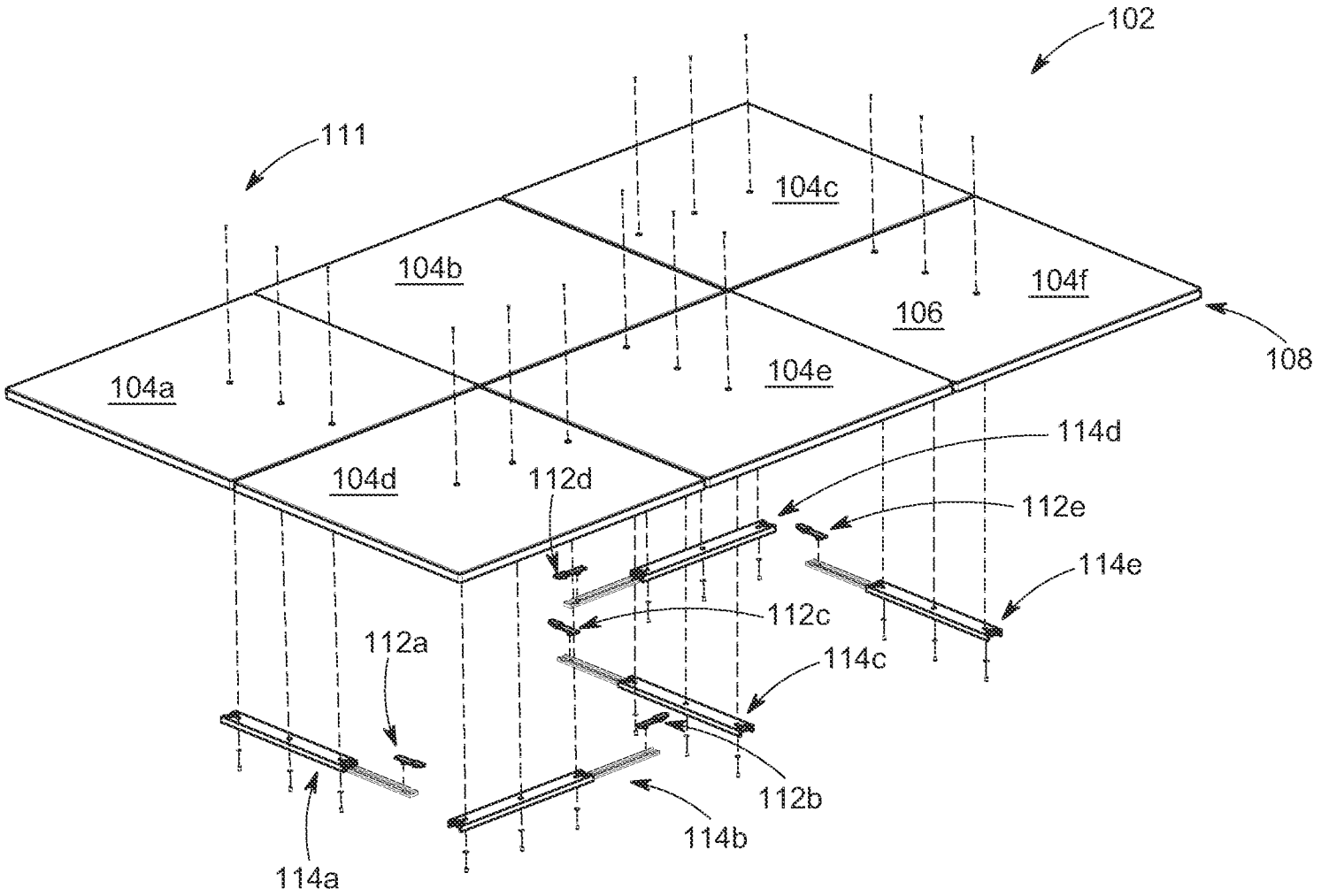
FIG. 1 depicts a pictorial illustration of an exploded view of an exemplary folding surface board in a fully expanded position.
Figure 2:
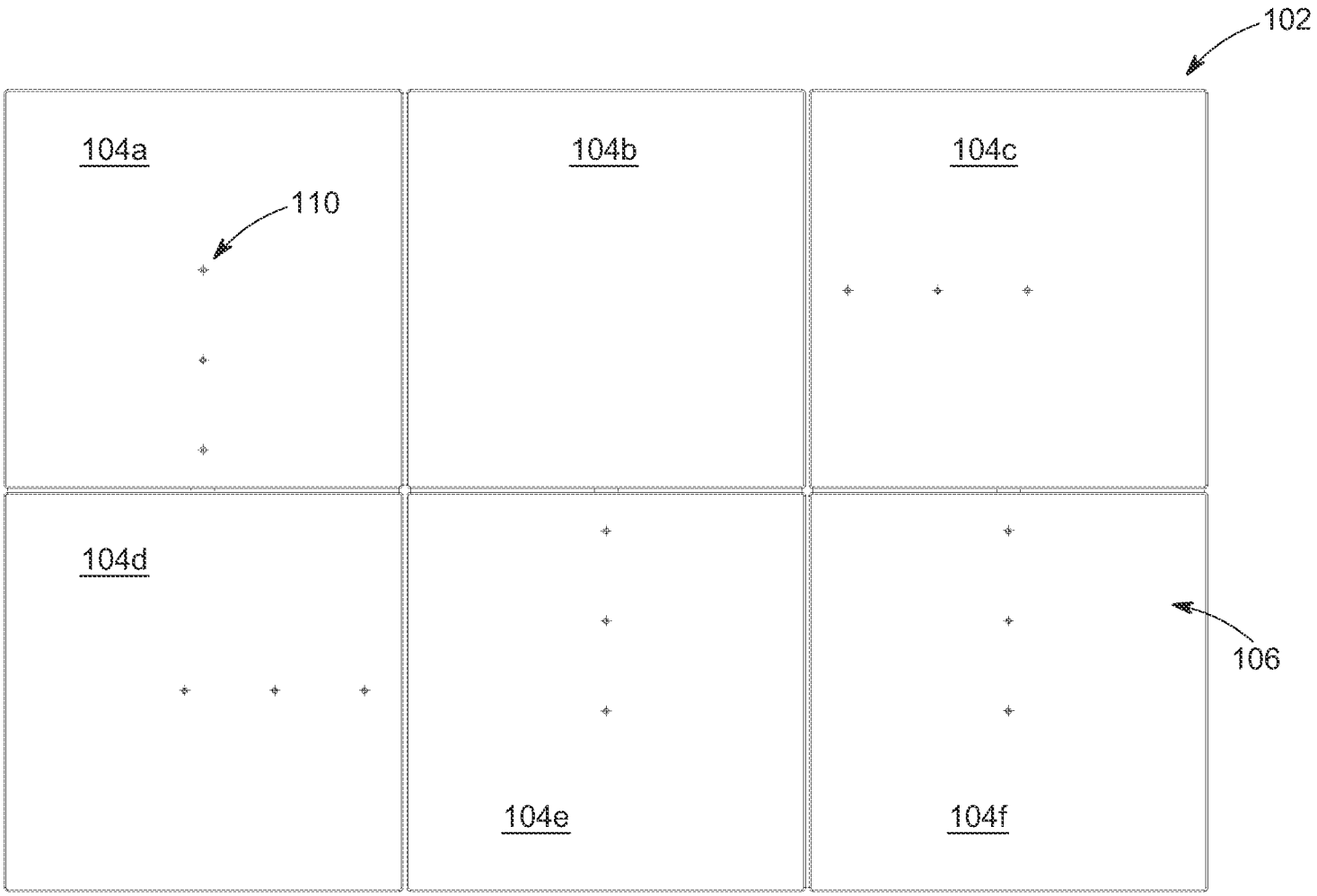
FIG. 2 depicts a pictorial illustration of a top view of the folding surface board in a fully expanded position.

The folding surface board 102, as shown in FIG. 1, is shown as an exploded view with multiple components, including multiple tiles 104*a*, 104*b*, 104*c*, 104*d*, 104*e*, and 104*f* that are adapted to serve as individual and separate elements that are connected to each other to form the whole folding surface board 102. The whole folding surface board 102 is a single unit made up of the individual tiles 104*a*-104*f* that are configured together. The top surface 106 of the folding surface board 102 is made up of the six tiles 104*a*-104*f* having a relatively flat and smooth surface as shown in FIG. 2 also. FIG. 2 illustrates the top surface 106 of the folding surface board 102 in its fully expanded state.

Figure 3:
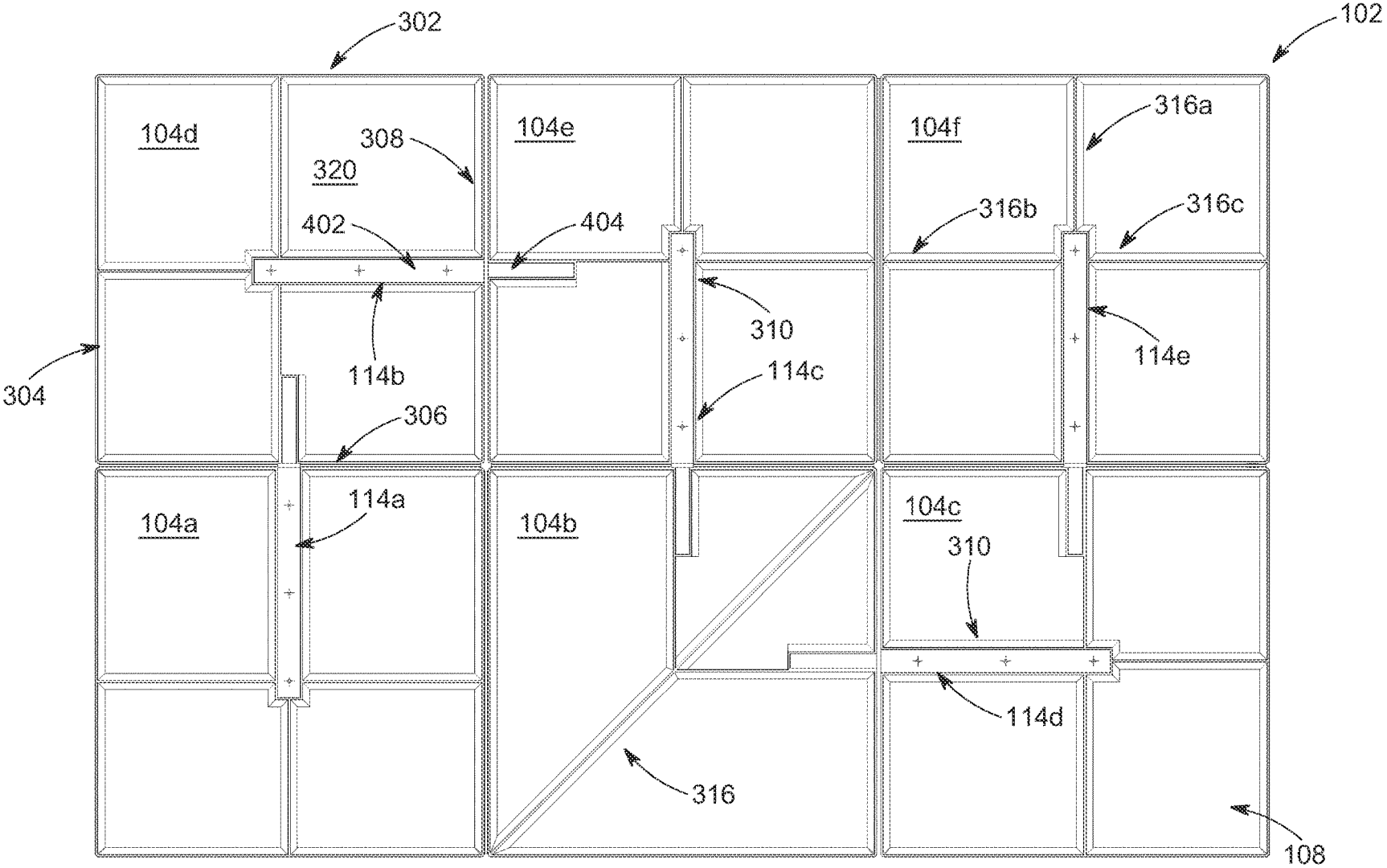
FIG. 3 depicts a pictorial illustration of a bottom view of the folding surface board in a fully expanded position.
Figure 8A:
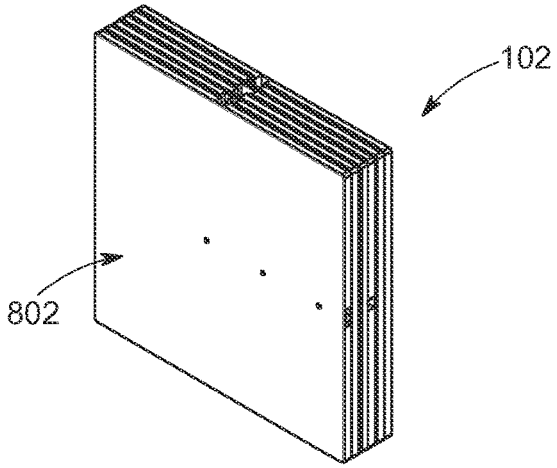
FIG. 8A depicts a fully folded folding surface board.
Figure 8B:
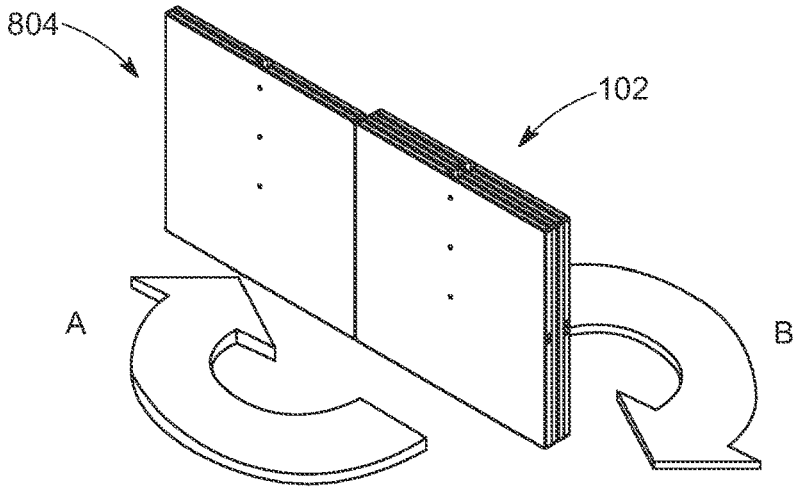
FIG. 8B depicts a partially unfolded folding surface board with two working top surfaces exposed.
Figure 8C:
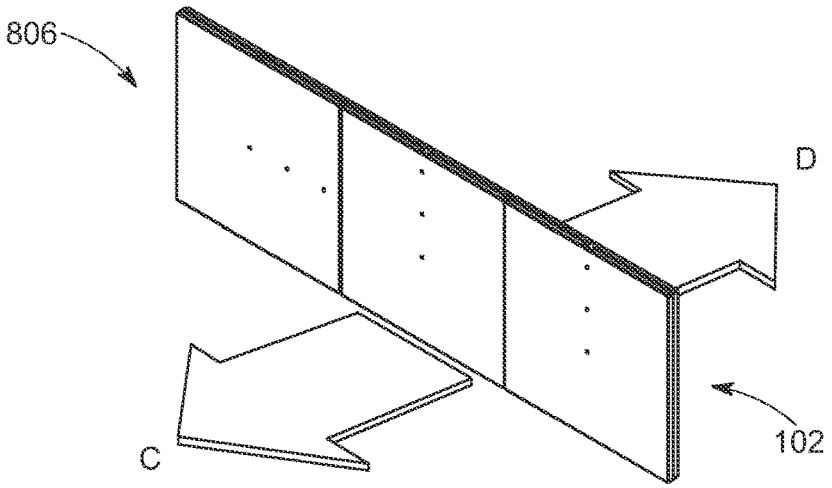
FIG. 8C depicts a half folded folding surface board.

The underside 108 of the folding surface board 102 is better shown in FIG. 3. As shown in FIG. 3, the underside 108 of the folding surface board 102 includes sliding and locking mechanisms (e.g., drawer slides 114*a*, 114*b*, 114*c*, 114*d*, and 114*e*) that allow the user to adjustably lock the surface board 102 to remain flat and temporarily immovable in particular when fully expanded in the 3×2 configuration (e.g., the 3×2 configuration 808 as shown in FIG. 8F).

As shown in FIG. 1, there may be one or more fasteners (e.g., three surface screws 111 configured to connect with the underlying drawer slides 114*a*, 114*b*, 114*c*, 114*d*, and 114*e*) from the top surface 106 to the bottom surface 108 of the folding surface board 102 and through one or more tiles 104*a*, 104*c*, 104*d*, 104*e*, and 104*f*.

Figure 5:
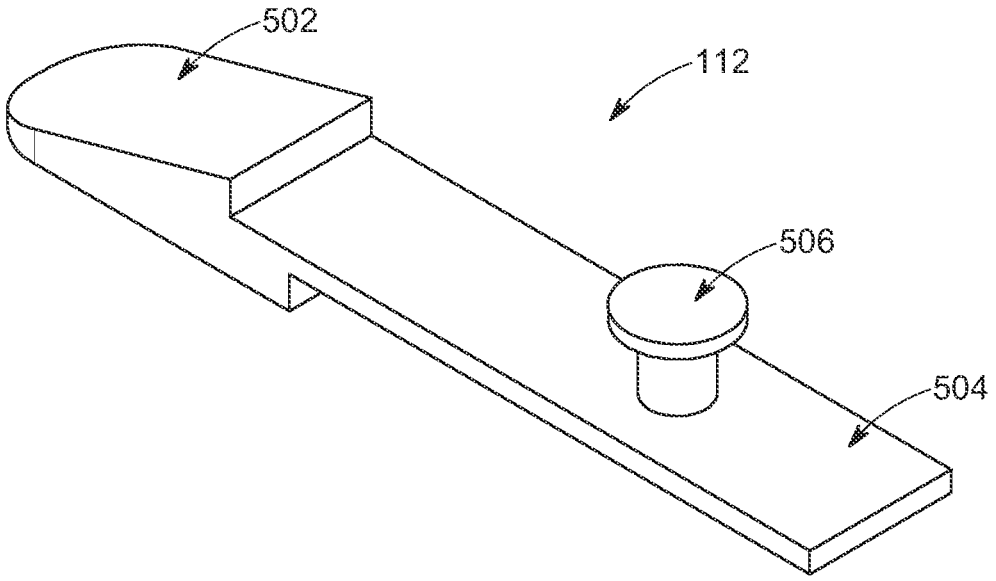
FIG. 5 depicts a pictorial illustration of an exemplary drawer snap.

In a non-limiting embodiment, a drawer snap 112*a*, 112*b*, 112*c*, 112*d*, and 112*e* as shown in the exploded view in FIG. 1, is, respectively, attached to each drawer slide 114*a*, 114*b*, 114*c*, 114*d*, and 114*e*. The drawer snaps 112 as illustrated in FIG. 5 are intended to assist their respective drawer slides 114 to be temporarily locked in place, as further shown in FIG. 6, thereby locking in place the overlying tile 104*a*-104*f* if the user so desires.

Figure 7:
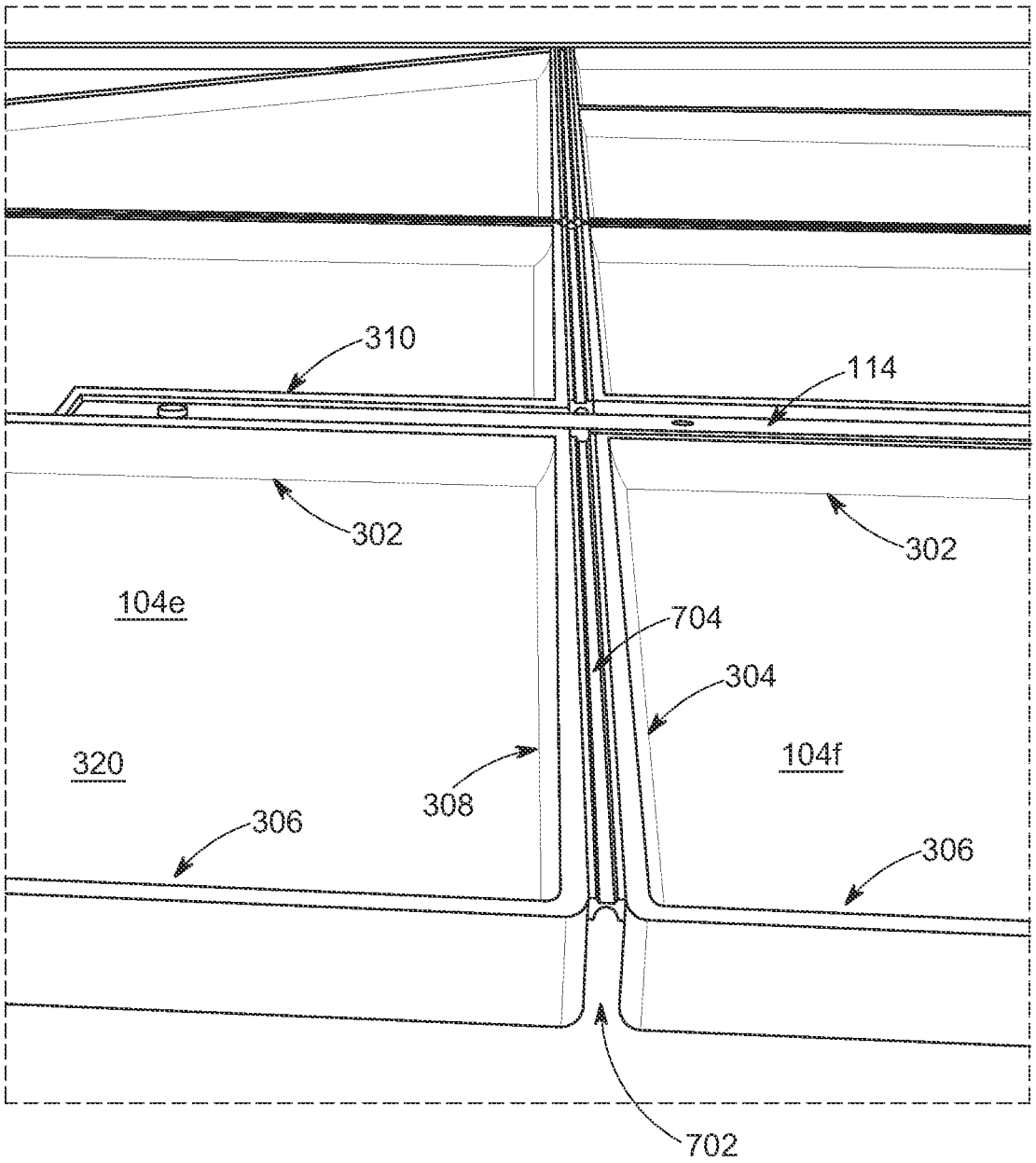
FIG. 7 depicts another view of an underside of the folding surface board with the folding seams as well as the integrated exemplary drawer slide.

In a non-limiting embodiment, there may be at least six separate yet connected tiles 104*a*, 104*b*, 104*c*, 104*d*, 104*e*, and 104*f*. As shown in FIG. 3, they may be connected along multiple foldable side edges (e.g., 704 as shown in FIG. 7) for each tile 104*a*, 104*b*, 104*c*, 104*d*, 104*e*, and 104*f* In a non-limiting embodiment, each tile 104*a*-104*f* comprises a top side 302, a left side 304, a bottom side 306, and a right side 308 to form preferably a square shape for each tile 104*a*-104*f*. In other non-limiting embodiments, each tile

104*a*-104*f* may alternatively form a rectangle shape. In a non-limiting embodiment, each tile 104*a*-104*f* shares at least two folding edges with an adjacent tile 104*a*-104*f* as shown in FIG. 3. In some cases, a tile, such as tiles 104*e* and 104*b* may share three folding edges with the adjacent tiles on the folding surface board 102.

In a non-limiting embodiment, each tile 104*a*-104*f* includes one or more ribs 316 on a underside surface 108 of the folding surface board 102, such as ribs 316*a*, 316*b*, and 316*c* shown in FIG. 3 and marked for tile 104*f*. These ribs 316 may serve as reinforcing elements on the underside 108 of the folding surface board 102 to reinforce the strength and integrity for each tile 104*a*-104*f* of the folding surface board 102. While some ribs 316 may be arranged in a straight line in a horizontal or vertical direction as shown for tile 104*f*, for other tiles, the ribs 316 may be arranged in a diagonal direction as well, as shown for tile 104*b*.

Figure 6:
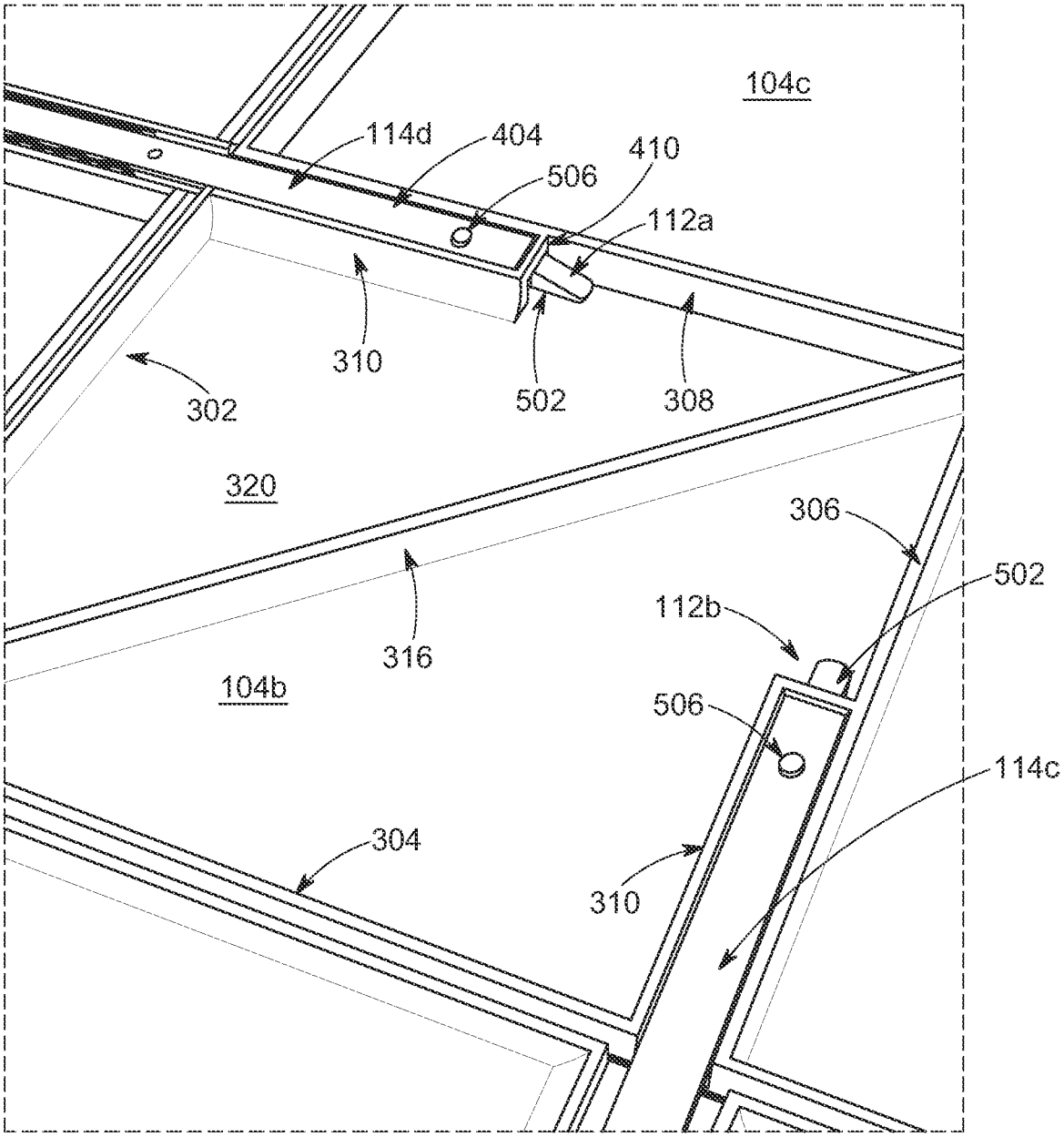
FIG. 6 depicts a pictorial illustration of an exemplary drawer slide positioned within an integrated opening in an underside of the folding surface board with an attached drawer snap.
Figure 8D:
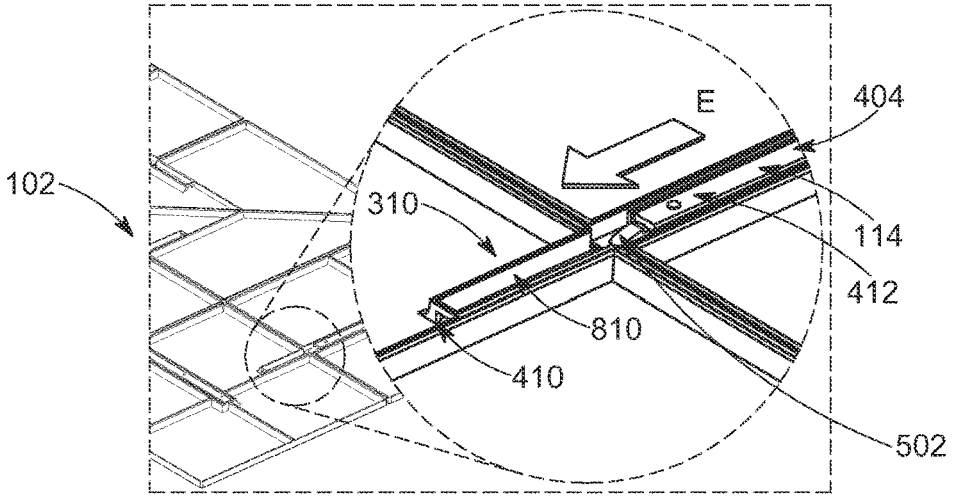
FIG. 8D depicts a method for extending a traveling member of a drawer slide on an underside of the folding surface board.

In a non-limiting embodiment, there may be a set of drawer slide apertures 310 built into the underside of the folding surface board 102 and built into the underside of each tile 104*a*-104*f* as shown in FIG. 3 and also in FIG. 6, FIG. 7, and FIG. 8D. It is noted that the term "set" as used herein may refer to one or more items.

Figure 4A:
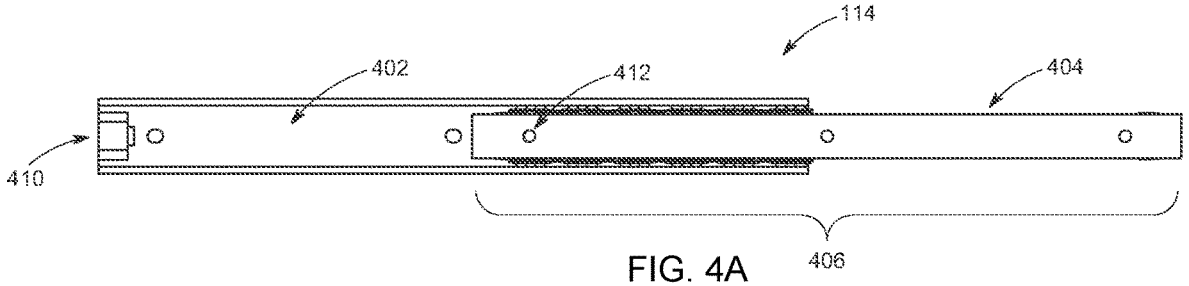
FIG. 4A depicts a pictorial illustration of an exemplary drawer slide in an extended position.
Figure 4B:
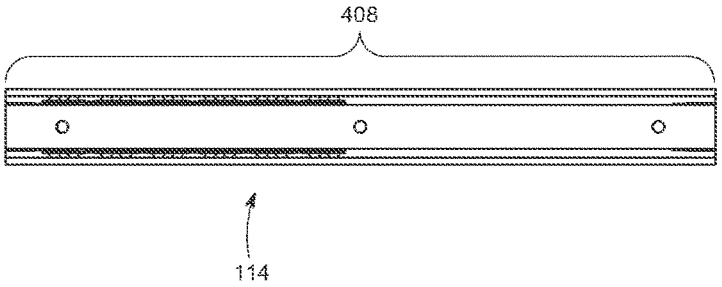
FIG. 4B depicts a pictorial illustration of the exemplary drawer slide in a retracted position.

Accordingly, the set of drawer slide apertures 310 may be formed as shown in FIG. 3, FIG. 6, FIG. 7, and FIG. 8D. The length of each drawer slide aperture 310 is designed to accommodate a drawer slide 114 in its retracted or fully extended form. FIG. 4A shows an example of a drawer slide 114 in its fully extended form and FIG. 4B shows the drawer slide 114 in its fully retracted form having its retracted length 408. As known about drawer slides such as drawer slide 114, drawer slides 114 comprise a first member 402 and a second member 404. The first member 402 is meant to be stationary and affixed to the underside of a tile 114 (e.g., such as in the arrangement shown in FIGS. 1-3), while the second member 404 is meant to travel along the travel length 406 and be movable. The second member 404 is affixed to the first member 402 of the drawer slide 114 in such a manner that the second member 404 can move forward in a fully extended position as shown in FIG. 4A or retract back in a fully retracted position as shown in FIG. 4B.

In a non-limiting embodiment, there are five drawer slides 114*a*-114*e* utilized and arranged on an underside of the folding surface board 102 as shown in FIGS. 1-3 and five sets of drawer slide apertures 310. Accordingly, a number of drawer slide apertures 310 is equal to the number of drawer slides 114 utilized on an underside of the folding surface board 102. Further, in a non-limiting embodiment, at one end of the drawer slide 114 is an opening 410 that the tab portion 502 of a drawer snap 112 is designed to fit into in order to temporarily and adjustably lock the moving or traveling second member 404 of each drawer slide 114 in place.

FIG. 5 shows an example of a drawer snap 112. The drawer snap 112 may include a tab portion 502. In a non-limiting embodiment, the tab portion 502 of the drawer snap 112 may include an angled tab portion 502. The tab portion 502 is connected to an elongated member 504 with a protruding vertical piece 506 that protrudes from the top surface of the elongated member 504. In a non-limiting embodiment, the protruding member 506 of the drawer snap 112 fits within an opening of a same size, such as opening 412 shown in FIG. 4A that is dedicated to receiving the protruding member 506 of the drawer snap 112 in order to connect or affix each drawer snap 112 to the second member 404 (the traveling member) of each drawer slide 114. Further, one or more connecting fasteners (e.g., fasteners 111 shown in FIG. 1) may also help to connect the drawer snaps 112 to the drawer slides 114.

As noted above, in a non-limiting embodiment, there may be five separate drawer slides 114. Accordingly, there may be five drawer snaps 112 on an underside of the folding surface board 102 in one or more non-limiting embodiments.

FIG. 6 shows the drawer snap 112*a* connected to the second member 404 of the drawer slide 114*a* with the second member 404 fully extended within the designated drawer aperture 310 and the tab portion 502 positioned within the opening 410 and held against a top surface of the end or exit of the drawer slide aperture 310. The tab portion 502 of the drawer snap 112*a* or drawer snap 112*b*, as shown in FIG. 6, can extend through the back opening 410 of the drawer slide aperture 310 and then is held by friction against the back top, left, and right sides of the drawer slide aperture 310. The tab portion 502 of each drawer snap 112 is designed to fit well within the opening 410 at the end of the drawer slide apertures 310. A user would then press down on the top surface of the tab portion 502 to release the tab portion 502 from being held against the back sides of the drawer slide aperture 310, such that the tab portion 502 of the drawer snap 112 can be pushed back through the opening 410 and the drawer slide traveling second member 404 be forced back into the drawer slide aperture 310 in its retracted position (e.g., as shown in FIG. 4B) having length 408 as opposed to 406 in FIG. 4A.

Accordingly, in a non-limiting embodiment, a user may manually lock and unlock using the drawer slides 114 and connected drawer snaps 112 contained within each drawer slide aperture 310 in order to lock in place each tile 104*a*-104*f*. In particular, in a non-limiting embodiment, the drawer slides 114 and drawer snaps 112 may be locked when the user desires the folding surface board 102 to remain in a locked 3×2 configuration, which is shown as 3×2 configuration 808 as shown in FIG. 8F with two rows of three tiles 104 on each row. As further explained below, in a non-limiting embodiment, the user may not need to manually engage the drawer slides 114 and drawer snaps 112 except to lock the tiles 104*a*-104*f* in place in a 3×2 configuration 808, with three connected tiles 104*a*, 104*b*, 104*c* on a top row and three connected tiles 104*d*, 104*e*, 104*f* on a bottom row to form the fully expanded folding surface board 102. In a non-limiting embodiment, to unfold the folding surface board 102 into the folded configuration 804 shown in FIG. 8B (with two exposed working surfaces of the top two tiles 104) and in the half folded configuration shown in FIG. 8C (with three exposed working surface of the top three tiles 104), the user does not have to lock in place or unlock the drawer slides 114 and/or drawer snaps 112. Rather, the user pulls the tiles 104 into the desired arrangement as shown in FIG. 8B and in FIG. 8C. In other non-limiting embodiments, it may be required or desirable to lock the drawer slides 114 and drawer snaps 112 in place even in such configurations as shown in FIG. 8B and in FIG. 8C.

In a non-limiting embodiment, there may be a drawer slide 114*a* (and drawer slide aperture 310) extending on an underside 108 of the folding surface board from tile 104*a* into tile 104*d*. There may also be a drawer slide 114*b* extending from tile 104*d* into tile 104*e*. There may also be a drawer slide 114*d* extending from tile 104*b* into tile 104*c*. There may also be a drawer slide 114*e* extending from tile 104*f* into tile 104*c*. In this manner, the user may lock in place the respective tiles 104*a*-104*f* when the drawer slides 114 are fully engaged using the tab 502 of the drawer snaps 112.

FIG. 6 further shows that the underside 320 of each tile 104*b* as an example of the other remaining tiles 104. In a non-limiting embodiment, the underside 320 of each tile 104 may be recessed from the surrounding side walls 302, 304, 306, and 308 of each tile 104*a*-104*f*. In such a manner, the ribs 316 may protrude down from the underside 320 of each tile 104*a*-104*f*. Further the drawer slide apertures 310 may be built into and fit to sit under the underside recessed surface 320 of each tile 104*a*-104*f*.

FIG. 7 shows an example of an underside 320 of each tile 104*e* and 104*f* as well as the side walls 302, 304, 306, and 308 for each tile 104*e* and 104*f* Further, FIG. 7 provides a close up view of the folding edges 704 extending between each tile 104*a*-104*e*. FIG. 7 further provides a close up vie of the gap 702 that may exist between the adjacent tiles 104*a*-104*f* to allow for the folding of the tiles 104*a*-104*f* to occur. The gap 702 may extend between the adjacent tiles 104*a*-104*f* such that the folding edge 704 is on a same place as a lowermost edge of each side wall 302, 304, 306, and 308 when the folding surface board 102 is turned facing up (e.g., as shown in FIG. 2.

Figure 8E:
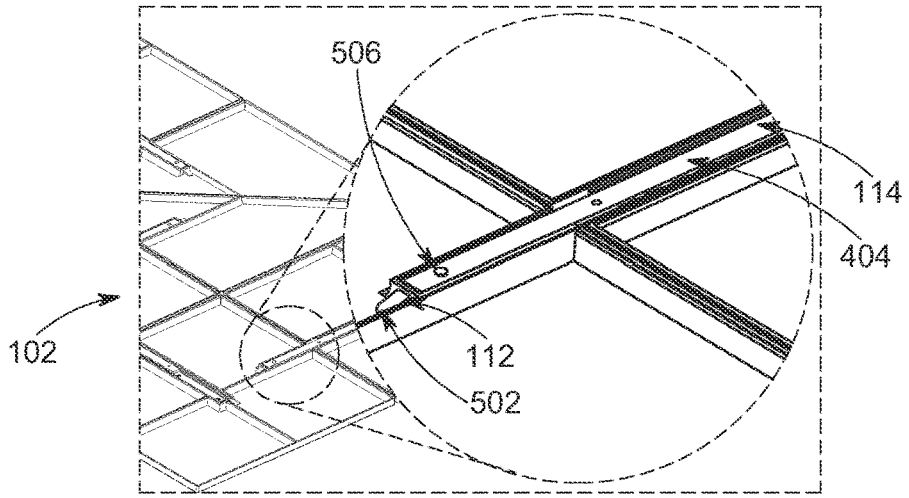
FIG. 8E depicts a method for locking the drawer slide in place on the underside of the folding surface board.

FIGS. 8A-8F may show an example process for how to fold a folding surface board 102 according to one or more non-limiting embodiments. In a non-limiting embodiment, a folding surface board 102 may be folded so that all six tiles 104*a*-104*f* are stacked one on top of each other as shown in FIG. 8A as folded configuration 802 while still connected along the folding edges 704. In this folded configuration 802, the user may still benefit from the folded folding surface board 102. For example, FIG. 9 shows an environment 902 in which the folding surface board 102 is fully folded in the folded configuration 802 and the user has a lap top supported by the top surface or exposed working surface of the top tile 104 of the folded configuration 802. Advantageously, the user is able to benefit from the height offered by the fully folded stacked configuration 802 for the folding surface board 102 in order to raise the lap top to the desired eye level (e.g., for the child shown in FIG. 9) and benefit from the folding surface board 102 even when fully folded. It may also be useful to fully fold the folding surface board 102 into the folded configuration 802 shown in FIG. 8A and in FIG. 9 when storing or transporting the folding surface board 102. Accordingly, the fully folded configuration 802 shown in FIG. 8A is useful to provide height and depth while providing a working surface of the one exposed tile 104 stacked over the remaining tiles 104, or for easy storage with a smaller profile than the fully unfolded configuration 808 shown in FIG. 8F.

FIG. 8B shows a next step of the process for unfolding the fully folded surface board 102 from its fully folded configuration 802 shown in FIG. 8A. To expose two working surfaces of only two tiles 104*a*-104*f*, the user may unfold a left side in direction A such that one tile portion has an exposed working surface and unfold to the right side in direction B such that another working surface of a tile 104 is exposed with the remaining unfolded tiles 104 located beneath the top exposed tile 104.

FIG. 8C shows that the user may also fold the folding surface board 102 in half in a half folded configuration 806. To unfold from the half-folded configuration 806, the user would pull the two rows in direction C and direction D as shown in FIG. 8C. FIG. 10 shows an environment 1002 in which the half folded configuration with 3 tiles 104 exposed and 3 remaining tiles 104 folded under the folding surface board 102 being utilized to support a lap top also but in a different arrangement than as shown in FIG. 9.

Figure 8F:
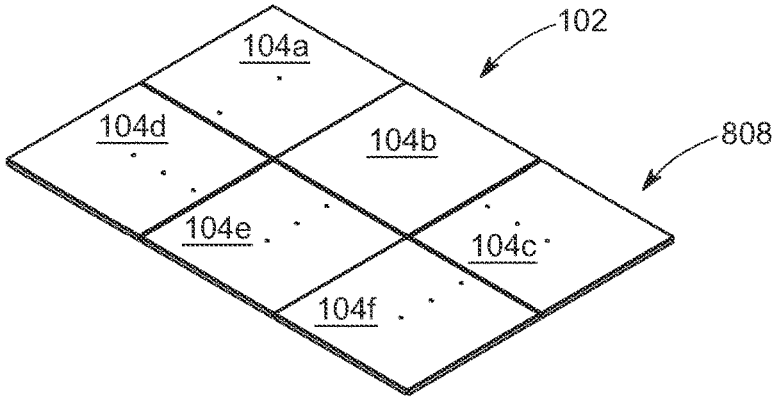
FIG. 8F depicts a fully unfolded folding surface board in a 3×2 configuration.

FIG. 8F shows the folding surface board 102 in its fully open, unfolded configuration 808 with all six tiles 104*a*-104*f* having their working surfaces exposed and ready for use. FIG. 8D and FIG. 8E provide exemplary pictorial images of how this fully unfolded configuration 808 as shown in FIG. 8F may be achieved. Notably, each drawer slide 114 is extended such that the tab portion 502 of a drawer snap 112 and attached second member 404 of the drawer slide 114 is pushed in the direction of arrow E by the user through the interior cavity of the drawer slide aperture 310 and towards opening 410.

FIG. 8E shows then that the tab 502 may be pushed through the opening 410 at the back end of the drawer slide aperture 310 and released so that the tab 502 may be held by friction and contact with the top edge and sides of the drawer slide aperture 310 until a user depresses the tab 502 again in order to release the drawer slide 114 and unlock the drawer slide 114 from that respective position. Once the user depresses the tab portion 502, the user can push back down on the tab portion 502 of the drawer snap 112 and the second member 404 of the drawer slide 114 can be moved to return to its retracted position (e.g., as shown in FIG. 4B) within the interior cavity 810 of the drawer slide aperture 310.

In a non-limiting embodiment, in order to be useful as a smaller sized folding surface board 102, the folding surface board 102 may have a width of approximately 33.20 inches by 22.10 inches in length. Each tile may be about 11 inches wide in one or more non-limiting embodiment. It is noted that other dimensions may be used in other embodiments.

Accordingly, FIG. 1-10 provide various views of a useful and portable folding surface board 102 having multiple folding configurations.

FIGS. 11-13 provide another example of a folding surface board 1102. The folding surface board 1102 as shown in FIGS. 11-13 is very similar to the folding surface board 102 shown in FIGS. 1-10 and may have the same flexibility of use and purpose to be used and folded as desired by a user to meet the user's academic, working, entertainment, or presentation and display needs.

FIG. 11 shows a bottom surface 1118 for a folding surface board 1102 while FIG. 12 shows a top surface 1120 for folding surface board 1102 according to one or more non-limiting embodiments. As shown in FIGS. 11-12, the folding surface board 1102 comprises multiple tiles 1104*a*-1104*f* that are positioned in two rows of three tiles 1104 each. In a non-limiting embodiment, there are at least six tiles 1104*a*, 1104*b*, 1104*c*, 1104*d*, 1104*e*, and 1104*f* as shown in FIGS. 11-12. In other non-limiting embodiments, the folding surface board 1102 may include a greater or lesser number of tiles 1104*a*-1104*f* and is not limited to the embodiment shown in FIGS. 11-13.

The folding surface board 1102 may have a generally rectangular shape in a non-limiting embodiment, and may include a top edge 1130, bottom edge 1132, left side edge 1133, and right side terminal edge 1135 as shown in FIG. 11.

The folding surface board 1102 incorporates multiple sliding locks 1116 as shown in FIG. 11 to allow each tile 1104 to fold along the folding seam lines 1106, 1108, and 1109. As shown in FIG. 11, there may be at least two vertical folding seam lines 1106, 1108 that run or extend along the full vertical length of the folding surface board 102 and at least one centrally placed horizontal seam line 1109 that extends the full horizontal width of the folding surface board 1102. As shown in FIG. 11, there may be at least five (5) sliding locks 1116*a*, 116*b*, 1116*c*, 1116*d*, and 1116*e*. Further, there may be multiple hinges 1117*a*, 1117*b*, 1117*c*, 1117*d*, 1117*e*, 1117*f*, 1117*g*,1117*h*, and 1117*i* as shown in FIG. 11 and FIG. 12. The multiple sliding locks 1116*a*-1116*e* and the multiple hinges 1117*a*-1117*i* function to allow the multiple tiles 1104*a*-1104*f* to fold and stack with relation to each other while remaining a single unit and attached in a single folding surface board 1102.

As shown in FIG. 13, the folding surface board 1102 can be fully folded or closed so that only one tile (e.g., tile 1104*a*) has an exposed working surface and the remaining tiles 1104*b*-1104*f* are stacked and folded beneath the exposed tile 1104*a*. In such as case, the sliding locks 1116*a*-1116*e* are manipulated and adjusted to cause each tile 1104*b*-1104*f* to fold and stack with respect to the other. The inclusion of the hinges 1117*a*-1117*i* further assist in the folding and stacking of the tiles 1104*a*-1104*f* with respect to each other.

As noted above, in a non-limiting embodiment, folding surface board 1102 may incorporate at least five sliding locks 1116, although a greater or lesser number of sliding locks 1116 may be incorporated in other non-limiting embodiments.

Each slide lock 1116*a*-1116*e* as shown in FIG. 11 and FIG. 3 may be manipulated to either lock and hold multiple adjacent tiles 1104 in place next to each other and exposed or may be manipulated to be unlocked to allow for the tile 1104 to fold and stack with respect to another tile 1104. Further, as shown in FIGS. 11-12, the sliding locks 1116*a*-1116*e* may be distributed along a bottom surface 1118 of the folding surface board 1102 thereby leaving a top surface 1120 of the folding surface board 102 free of the sliding locks 1116*a*-1116*e*. This may make it easier if the folding surface board 1102 is used as a writing surface or other display or working surface such that the sliding locks 1116*a*-1116*e* do not interfere with the writing surface or other display or working surface.

It is noted that in other embodiments, other types of fasteners may be used in place of slide locks 1116*a*-1116*e*. For example, brackets may be incorporated instead of sliding locks 1116*a*-1116*e*. The brackets may be included along the folding seam lines 1106, 1108, and 1109 so that the various tiles 1104*a*-1104*f* may still rotate and stack beneath each other. Further, in a non-limiting embodiment, the hinges 1117*a*-1117*i* may be incorporated into the actual tiles 1104*a*-1104*f* rather than being placed as hinge joints between the folding seams 1106, 1108, and 1109. In such cases, the hinges 1117*a*-1117*i* may be somewhat raised and may be located along bottom or side edges of each tile 1104*a*-1104*f*.

As noted above, the folding surface boards 102 and 1102 are useful in their versatility and allowing the user how much or how little of the tile portions 104*a*-104*f* and 1104*a*-1104*f* to leave unfolded and open depending on the user's work needs or use needs. It is anticipated that the folding surface boards 102, 1102 may be useful for a number of activities and purposes. The top surfaces of each tile of the folding surface boards 102, 1102 may act as a writing or display surface.

The folding surface boards 102, 1102 may be useful for entertainment purposes such as cardplaying or playing any number of board or card games and/or puzzles. The versatility of the folding surface boards 102, 1102 may be useful for completing projects for work or for academic purposes. Further, the folding surface boards 102,1102 may be useful for displaying jewelry or other items in stores, kiosks, trade shows, or any number of locations. The folding surface boards 102, 1102 may be used to replicate the service and functions of one or more trays including a service tray, breakfast tray, or the like. The above-provided uses are merely exemplary and non-limiting, as there are many possible uses for the folding surface boards 102 and 1102.

As noted above, the folding surface boards 102, 1102 have numerous uses and advantages over traditional working surfaces. The folding surface boards 102,1102 can be placed on a user's lap and/or on a soft surface such as a bed or couch. The folding surface boards 102,1102 can be folded in any number of configurations as shown above.

In a non-limiting embodiment, the folding surface board 102 may be configured to include other elements not shown in the Figures above, including a drink holder that may be incorporated into the folding surface boards 102, 1102 so that a user can store a drink. Further, a set of legs and handles may further be added to the folding surface boards 102, 1102. Further, the folding surface boards 102, 1102 may incorporate one or more charging ports for the user to charge the user's smartphone phones or other computing devices. Further, in a non-limiting embodiment, the folding surface boards 102, 1102 may include a slip resistant coating or spray to prevent slipping on the working surface of the folding surface boards 102, 1102. Many other advantages and benefits may be provided by the one or more systems and components described herein.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, and steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose lower limit is the first number and whose upper limit is the second number. For example, to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted. The term "coupled to" as used herein may refer to a direct or indirect connection.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A folding surface board, comprising:

a body comprising:

at least six tiles connected to each other to form an overall rectangular shape comprised of the at least six tiles, wherein each tile of the at least six tiles is divided by one or more folding edges or folding seams, wherein the at least six tiles when fully expanded are divided in a three by two (3×2) configuration with three tiles on a top row connected to three tiles on a bottom row of the folding surface board when fully expanded; and a set of sliding mechanisms attached to an underside of the body;

wherein the folding surface board is configured to be manipulated from a fully expanded to a partially expanded to a fully folded configuration, wherein the at least six tiles are configured to fold in half wherein there are at least three exposed working surfaces on three upward facing tiles of the at least six tiles, and a remaining set of tiles are folded beneath the three upward facing tiles.

2. The folding surface board of claim 1, wherein the set of sliding mechanisms comprise drawer slides, wherein the drawer slides comprise a stationary member and a traveling member, and wherein a drawer snap is connected to the traveling member of each drawer slide.

3. The folding surface board of claim 2, wherein the underside of the body of the folding surface board comprises a set of drawer slide apertures dedicated to containing the set of drawer slides.

4. The folding surface board of claim 3, wherein a length of the set of drawer slide apertures is at least as long as a length of a drawer slide when the traveling member of the drawer slide is fully extended, wherein the set of drawer slide apertures is configured to store the drawer slide in its fully extended and fully retracted state.

5. The folding surface board of claim 3, wherein a number of the set of drawer slide apertures is equivalent to a number of the set of drawer slides.

6. The folding surface board of claim 2, wherein a set of drawer slide apertures comprises an opening at an end of each drawer slide aperture of the set of drawer slide apertures configured to receive a tab on the drawer snap, wherein the tab is configured to adjustably and temporarily lock the tab of the drawer snap attached to each drawer slide in place.

7. The folding surface board of claim 2, wherein each tile of the at least six tiles has at least one drawer slide aperture built into or located on an underside of each tile of the at least six tiles.

8. The folding surface board of claim 1, wherein all tiles of the at least six tiles can be folded in a fully folded configuration wherein the all tiles of the at least six tiles are stacked on top of each other with one upward facing exposed working surface.

9. The folding surface board of claim 1, wherein the at least six tiles are configured to be folded such that there are two exposed working surfaces on two upward facing tiles of the at least six tiles, and a remaining set of tiles are folded beneath the two upward facing tiles.

10. The folding surface board of claim 1, wherein each tile has a rectangular shape or a square shape.

11. The folding surface board of claim 1, wherein each tile of the at least six tiles shares at least two foldable edges with another tile.

12. The folding surface board of claim 1, wherein each tile of the at least six tiles comprises a recessed underside with one or more ribs protruding down from the recessed underside.

13. A method of using a folding surface board, comprising:

determining how many working surfaces of one or more tiles of the folding surface to expose and how many remaining tiles of the folding surface board to fold, wherein the folding surface board comprises at least six tiles connected to each other by at least one folding edge, wherein the at least six tiles are configured to fold in half wherein there are at least three exposed working surfaces on three upward facing tiles of the at least six tiles, and a remaining set of tiles are folded beneath the three upward facing tiles; and responsive to determining how many exposed working surfaces of the one or more tiles of the folding surface to expose and how many remaining tiles of the folding surface board to fold, folding or unfolding a required number of tiles to display a desired number of working surfaces of the one or more tiles of the folding surface.

14. The method of claim 13, further comprising, folding the folding surface board in half such that three tiles of the folding surface board are connected to each other with exposed, upward facing tiles and three tiles are folded under the folding surface board.

15. The method of claim 13, further comprising, folding the folding surface board such that all the at least six tiles are stacked on top of each other while connected to each other.

16. The method of claim 13, wherein each tile of the at least six tiles are either a rectangular shape or a square shape.

17. The method of claim 13, wherein an underside of each tile comprises a sliding mechanism.

18. The method of claim 17, wherein the sliding mechanism is a drawer slide with a drawer snap attached to a traveling member of the drawer slide.

19. The method of claim 18, wherein each drawer slide is contained within a drawer slide gap built into or otherwise located on the underside of each tile of the folding surface board.

* * * * *